US005934658A

United States Patent [19]

Rydell et al.

[11] Patent Number: 5,934,658

[45] Date of Patent: Aug. 10, 1999

[54] CYLINDER CLINCHER FOR IMMOBILIZING DOT GAS CYLINDERS

[76] Inventors: Gordon F. Rydell, 115 Lancaster St., Victoria, Tex. 77904; Todd G. Rydell, 10050 Great Hills Trail, #216, Austin, Tex. 78759

[21] Appl. No.: 08/971,652

[22] Filed: Nov. 17, 1997

Related U.S. Application Data

[63] Continuation-in-part of application No. 08/717,856, Sep. 23, 1996, abandoned.

[51] Int. Cl.[6] ..... B25B 1/00

[52] U.S. Cl. ..... 269/131; 248/313

[58] Field of Search ..... 248/313, 316.1, 248/316.2, 154, 149, 499, 230.8, 143, 129, 500, 505; 269/130, 131, 132; 410/47, 48, 49, 50, 100, 97, 51; 280/47.34, 47.27, 659, 47.131; 414/448; 242/384.7

[56] References Cited

U.S. PATENT DOCUMENTS

| | | | |
|---|---|---|---|
| 795,147 | 7/1905 | Magoffin | 280/47.27 X |
| 1,300,567 | 4/1919 | Brorby | 414/448 |
| 1,429,432 | 9/1922 | Irrgang | 414/448 |
| 1,668,129 | 5/1928 | Spaeth | 280/47.27 |
| 1,977,725 | 10/1934 | Heidbrink | 248/154 X |
| 2,775,463 | 12/1956 | Chenette | 410/100 X |
| 3,031,184 | 4/1962 | Spencer | 248/55 X |
| 3,420,481 | 1/1969 | Arnes | 248/499 X |
| 3,595,559 | 7/1971 | Gettinger | 269/131 X |
| 3,635,104 | 1/1972 | Taylor et al. | 269/130 |
| 4,034,878 | 7/1977 | Fox | 414/448 |
| 5,632,461 | 5/1997 | Von Helms et al. | 248/230.8 X |

FOREIGN PATENT DOCUMENTS

| | | | |
|---|---|---|---|
| 250549 | 6/1948 | Switzerland | 248/143 |

*Primary Examiner*—Ramon O. Ramirez
*Assistant Examiner*—Stephen S. Wentsler
*Attorney, Agent, or Firm*—Joseph F. Long

[57] ABSTRACT

Dual posts mounted to a base with a support bar with a winch on one end fastened at right angles to the rearward side of the dual posts and a non stretchable belt fastened at a beginning end to one of the posts and pulled around the cylinder to be immobilized into a winch thereby allowing the cylinder to be held immobile by the force of the belt pushing the cylinder against the posts when the winch is tightened.

5 Claims, 2 Drawing Sheets

CYLINDER CLINCHER FOR IMMOBILIZING DOT GAS CYLINDERS

This application is a continuation-in-part of Ser. No. 08/717,856, filed Sep. 23, 1996 and entitled "A Cylinder Clincher for Immobilizing Circular Cylinder Containers" now abandoned. This continuation-in-part adds a cylinder support for smaller cylinders and a base to make the unit portable; changes the title to be more specific and clarifies the original claims and specification in necessary legal terms. In the title, DOT is the normal abbreviation for Department of Transportation and does not include cylinders containing oxygen or acetylene.

BACKGROUND OF THE INVENTION

Gases held in DOT cylinders are used in industry, in hospitals, in homes, in traveling vehicles etc. and are held under relatively high pressures in the cylinders. Each cylinder necessarily is closed with a cylinder valve to hold the pressurized gas therein. Normally this cylinder valve is connected to a regulator valve that is used to control the outward flow of gas as desired by the user after the user partially opens the cylinder valve. When the cylinder valve is damaged or for some reason needs to be replaced there is a need to immobilize the DOT cylinder without damaging the cylinder surface while applying sufficient force with a valve removal tool to unscrew the valve from the cylinder and to replace the valve to its full depth for safe operation. If the valve is mistakenly removed with high pressure gas therein the cylinder could be thrown with great force by jet action of the gas. The main objective of this invention is to provide a simple low cost unit to allow a user to not only safely immobilize cylinders of varying sizes but to also allow a user to remove and replace cylinder valves to the proper depth without damage to the cylinder surface.

The closest prior art we have found is U.S. Pat. No. 3,595,559 , filed Jun. 30, 1969 by J. F. Gettinger and entitled "Adjustable holding device". Gettinger is intended to hold an automobile bumper moveably in place to allow moving the bumper into the most desirable position for grinding, welding or pounding thereon. Our unit allows applying great force to immobilize a cylinder only in an upright position. In Gettinger a belt is tightened to hold a bumper in a horizontal position against notched plates. See lines 54 to 62 , Col. 2 of Gettinger. This is quite different than our use of a power device such as a winch and an essentially non stretchable belt to apply great force to immobilize a cylinder in an upright position against a curved surface. Gettinger also uses a spring loaded belt with a foot pedal release to hold a cylinder with the bumper holding unit mounted thereto moveably in place. The maximum force is limited to the strength of the spring. See lines 44 to 46, Col. 2 of Gettinger. This is also quite different than our use of a hand tightened winch or similar device to pull a belt with great force to immobilize an upright cylinder. Engineers have calculated that we use a force of several thousands of pounds of pressure to immobilize a cylinder.

SUMMARY OF THE INVENTION

The invention may be briefly summarized as a unit that allows immobilizing DOT cylinders that have some variation in diameter and length in an upright position while applying sufficient force to unscrew the cylinder closure valve from the cylinder. For safe removal of the valve the upright position is necessary since if a valve is inadvertently removed with a high gas pressure inside the cylinder the cylinder will be forced downward with great pressure. Pressure against a floor or sufficiently strong support would be innocuous. In the invention a winch and an essentially non stretchable belt is used to immobilize the cylinder by pulling the cylinder against rounded surfaces of upright support posts with great force. Other back up or rounded support surfaces could be used with some probable sacrifice in portability ,cost, or utility.

If a cylinder starts to turn as force is applied to remove the cylinder valve the winch may be further tightened to totally immobilize the cylinder. Scratching or marring the cylinder is quite undesirable and immobilizing using a flexible non stretch belt such as may be made from a plastic composite and tightening the belt with a winch or similar means prevents any damage to the cylinder while replacing a defective cylinder valve.

DETAILED DESCRIPTION OF THE INVENTION

Figure 1:
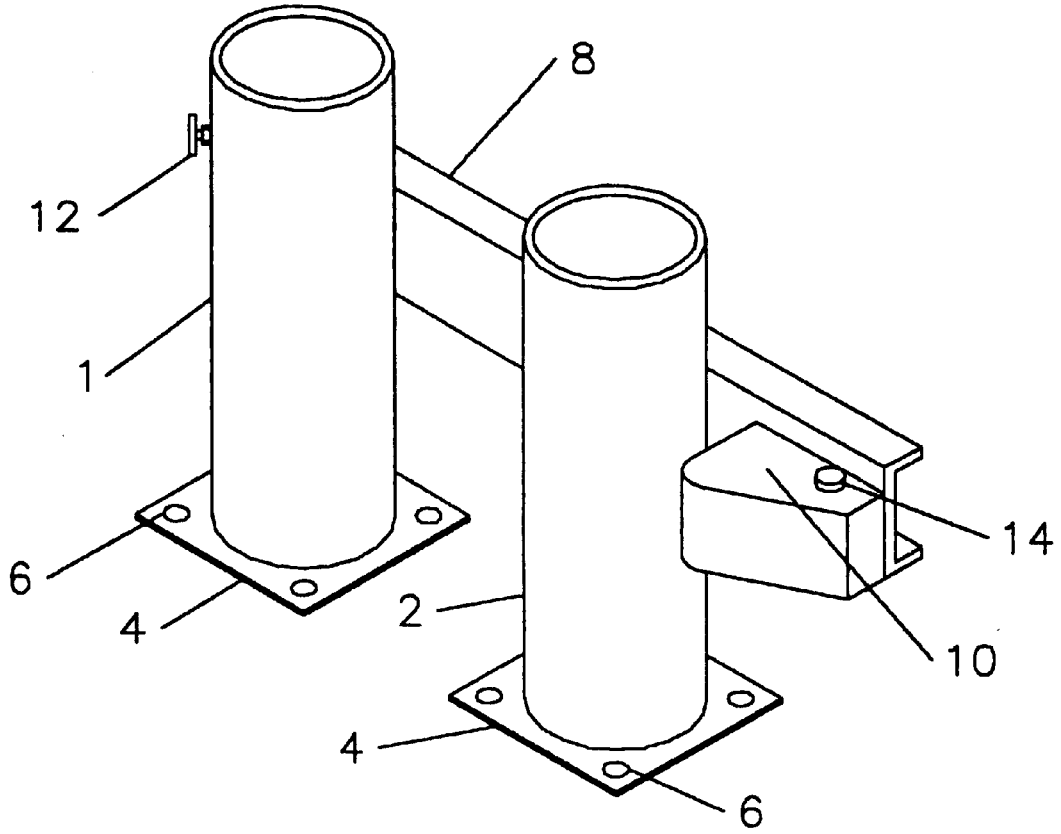
FIG. 1 shows a front three dimensional view of all major components of the unit except the clincher belt.
Figure 3:
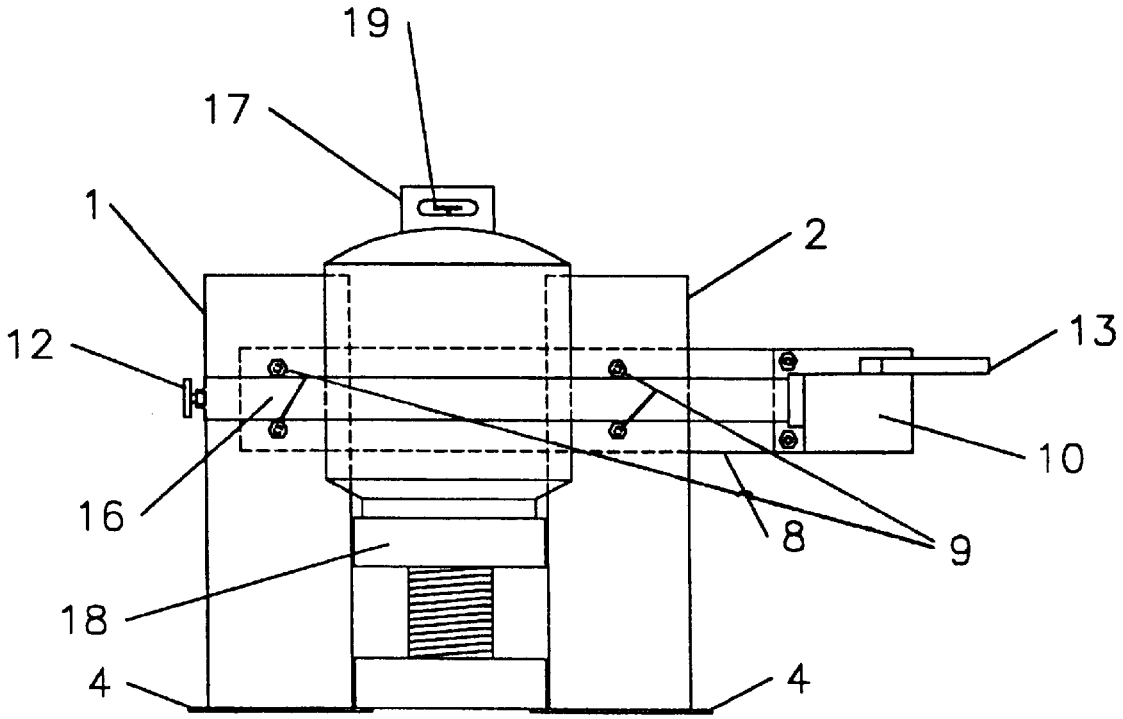
FIG. 3 shows a front view of the unit indicating a cylinder held in place by a clincher belt and resting on a cylinder support.

The invention may best be described from a detailed description of the drawings. FIG. 1 shows dual support posts, 1 and 2, mounted on individual bases 4 with lag bolts or normal bolts. The bases may be mounted to concrete or to many other fixed surfaces. Support posts are shown as round but other shapes would work equally as well. Shapes with a sharp edge would be objectionable as sharp edges would mar a cylinder when the cylinder is pulled tightly against the posts as indicated in FIG. 3. Support bar 8 which may be a single U shaped channel as shown or multiple channels serves to anchor the posts at a set distance apart and to hold and anchor the belt tightening winch 10. The beginning end of the clincher belt is anchored to post 1 with a fastener 12. The drive nut 14 serves to tighten winch 10. Most any tool may be used to tighten the drive nut 14.

Figure 2:
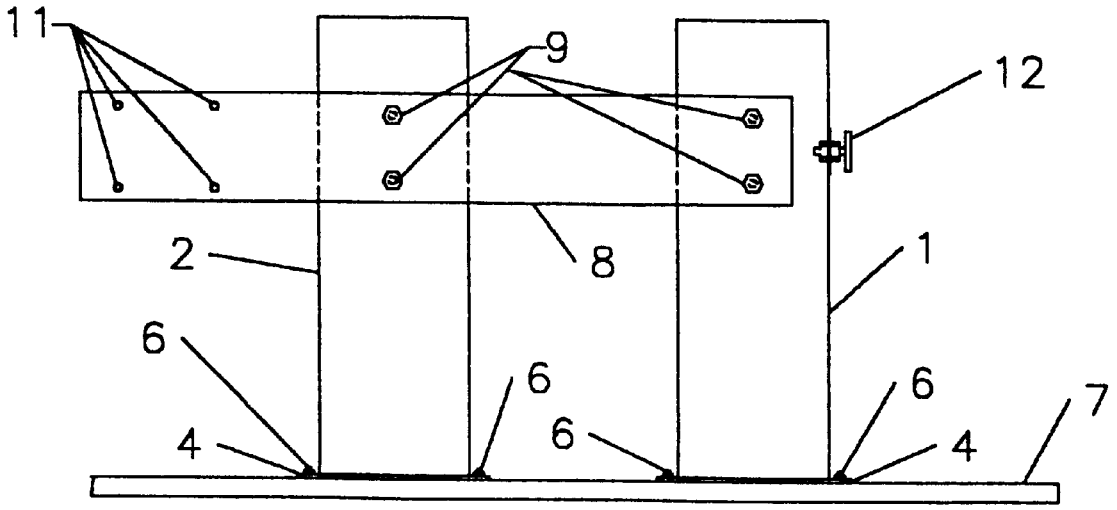
FIG. 2 shows a rearward view of the unit when mounted on a third base to allow portability.

FIG. 2 shows a rear view of the unit with dual post bases 4 mounted on a third base 7 with bolts 6 to allow the unit to be easily moved. Bolts 11 hold winch 10, FIG. 1 to support bar 8 and bolts 9 hold support bar 8 firmly attached to posts 1 and 2. Although bolts are indicated on the drawing, the bases, the winch or other tightener means, and the support bar all could be fastened as outlined by welding. Fastener 12 to fasten the beginning end of clincher belt 16, FIG. 3 to post 1 would be visible from this view. This fastener may be one or more bolts or a self tightening clip attached to the post.

FIG. 3 shows a front view of the unit with a short cylinder 15 held in place in front of posts 1 and 2 and supported on a removable extendable support 18 with clincher belt 16 fastened on a beginning end with fastener 12 about midway of cylinder 15. When clincher belt 16 is pulled tight with winch 10 by use of lever 13, preferably a ratchet type socket tool to tighten winch drive nut 14, and after pressure is slowly released by opening valve 19 the valve 19 may be removed with normal appropriate tools. The cylinder is provided with a valve protector ring 17. If valve 19 were removed with pressure in the cylinder 15 the cylinder would tend to project downward with great force. For safety reasons then the unit must hold the cylinder in an upright position and when a cylinder support is necessary a strong support should be used. There is considerable latitude in the ratio of the distance apart of the posts 1 and 2 and cylinder diameter. Ratios of distance between posts to cylinder diameter between posts from approximately 0.5 to 0.9 work successfully.

Figure 4:
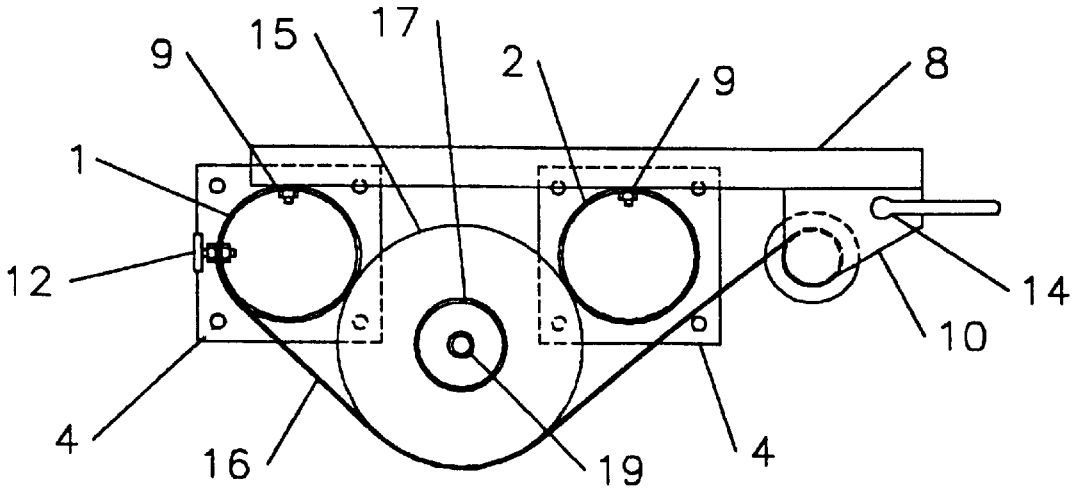
FIG. 4 shows a top view of the unit indicating major components and their interrelationship.

In FIG. 4 a top view of the unit is shown. The clincher belt 16 is fastened at a beginning end with fastener 12 and with cylinder 15 in place the clincher belt 16 is pulled around cylinder 15 and into winch 10 and winch drive nut 14 is used to pull the belt 16 tight to immobilize the cylinder 15. The pressure may be released through valve 19 before removing the valve 19. Of course, when valve 19 is removed because of defect, wear etc. the unit also can be used to facilitate installation of a new valve to full depth as is necessary for the safest installation. Clincher belt 16 may be made of most any strong belt material such as plastic composites as long as the belt is essentially non stretchable.

What is claimed is:

1. A cylinder clincher for immobilizing a circular DOT gas cylinder container comprising:

a) a first base plate and a second base plate, b) a first support post mounted to said first base plate and a second support post mounted to said second base plate, with said support posts capable of being mounted to have said support posts a lesser distance apart than a diameter of said DOT gas cylinder container being immobilized, c) a belt, a belt tightening means and at least one support bar, said at least one support bar being rigidly fastened to said first support post and said second support post at right angles to said posts with said belt tightening means being fastened to a projecting end of said at least one support bar;

d) a first end of said belt being fastened to said first post and wherein a second end of said belt is capable of being operably connected with said belt tightening means after passing around said cylinder container after said cylinder container has been placed against said support posts;

e) a removable extendable platform for adjusting a vertical position of said cylinder container between said support posts; and f) said belt tightening means for acting to immobilize said cylinder container by tightening said belt to pull said cylinder container against said posts.

2. The cylinder clincher for immobilizing a circular DOT gas cylinder container as in claim 1 further comprising a single base with both said first base plate and said second base plate mounted thereto.

3. The cylinder clincher for immobilizing a circular DOT gas cylinder container as in claim 1 wherein said belt tightening means is a winch capable of being operated with a ratchet type socket wrench.

4. A cylinder clincher for immobilizing a circular DOT gas cylinder container comprising:

a) rigidly mounted dual support posts, said dual support posts capable of being mounted a maximum distance apart equal to ten percent less than a diameter of said cylinder container being immobilized;

b) a support bar and a belt tightening means, said belt tightening means being mounted at a first end of said support bar and said support bar being securely fastened at a second end to a first of said dual support posts and said support bar being securely fastened to a second of said support posts at a point between said first end and said second end of said support bar;

c) an essentially non stretchable belt fastened at a beginning end to said first of said support posts and said belt capable of extending around said cylinder contain when said cylinder container is placed against said support posts, said belt connected with said belt tightening means to allow operation of said belt tightening means to tighten said belt to immobilize said cylinder container; and d) a removable extendable platform for adjusting a vertical position of said cylinder container between said support posts.

5. The cylinder clincher for immobilizing a circular DOT gas cylinder container as in claim 4 wherein said belt tightening means comprises a winch with a manual drive nut and a ratchet type lever.

* * * * *